US005328250A

United States Patent [19]

Upright

[11] Patent Number: 5,328,250

[45] Date of Patent: Jul. 12, 1994

[54] SELF-PROPELLED UNDERSEA NODULE MINING SYSTEM

[76] Inventor: Ronald Upright, 5408 Brookwood SE., Kentwood, Mich. 49508

[21] Appl. No.: 29,714

[22] Filed: Mar. 11, 1993

[51] Int. Cl.[5] ..... E21C 45/00; E02F 3/00

[52] U.S. Cl. ..... 299/8; 37/314; 299/9

[58] Field of Search ..... 299/8, 9; 37/313, 314

[56] References Cited

U.S. PATENT DOCUMENTS 4,357,764 11/1982 Lemercier et al. ..... 37/314 X
4,685,742 8/1987 Moreau ..... 37/314 X

FOREIGN PATENT DOCUMENTS 2561306 9/1985 France ..... 299/9

*Primary Examiner*—David J. Bagnell
*Attorney, Agent, or Firm*—H. Jay Spiegel

[57] ABSTRACT

A self-propelled machine has an internal chamber having a conveyor mechanism extending through an opening in a wall. A buoyancy control allows admission of pressurized air into the chamber to allow adjustment of the buoyancy of the machine. A series of conveyors within the chamber convey material into the chamber which is washed to leave behind sediment and other materials. Washed nodules are conveyed to a transport machine and are stacked in the transport machine. The transport machine may be disconnected from the self-propelled machine to allow nodules to be brought to the surface. Sensors are provided in the self-propelled machine to control attitude, direction, and movement.

14 Claims, 6 Drawing Sheets

SELF-PROPELLED UNDERSEA NODULE MINING SYSTEM

BACKGROUND OF THE INVENTION

The present invention relates to a self-propelled undersea nodule mining system. In the prior art, it is known to mine nodules from the surface of the ocean floor. However, Applicant is unaware of any prior art teaching all of the features and aspects of the present invention.

The following prior art is known to Applicant:

U.S. Pat. No. 4,070,061 to Obolensky discloses a method and apparatus for collecting mineral aggregates from sea beds. The Obolensky device is dragged or self-propelled over the ocean floor to dislodge nodules from the sea bed and to separate them from silt and sediment. The present invention differs from the teachings of Obolensky as contemplating a buoyancy control allowing the present invention to hover slightly above the ocean floor.

U.S. Pat. No. 4,391,468 to Funk discloses a method and apparatus for recovering mineral nodules from the ocean floor. The Funk device includes means for pumping a continuous flow of ocean water along a first confined path through an exchange position within the vicinity of the ocean floor where mineral nodules to be recovered are deposited. The method further includes confining ocean water within a second path within the same vicinity to continuously move a mixture of deposit mineral nodules and smaller particles. Funk also contemplates separating the minerals from other particles and conveying the nodules to the surface. The present invention differs from the teachings of Funk as contemplating buoyancy control, a separate transport vessel and a conveyor system for 30 separating the nodules from the associated silt.

U.S. Pat. No. 4,533,526 to Delacour et al. discloses a process for recovering polymetal compounds discharged from a submarine hydrothermal source and devices for carrying out the same. The Delacour et al. device is designed to sit on the ocean floor through the use of a bell-shaped collector member. The present invention differs from the teachings of Delacour et al. as contemplating a system having a self-propelled machine with buoyancy control and a separate transport machine to transport nodules to the surface.

U.S. Pat. No. 4,652,055 to Amann et al. discloses a device for collecting manganese nodules on the ocean floor, which device is towed over the ocean floor. The present invention differs from the teachings of Amann et al. as contemplating a self-propelled machine having buoyancy control and a separate transport machine to transport nodules to the surface.

U.S. Pat. No. 4,685,742 to Moreau discloses equipment for extracting ores from sea beds, which device includes a plurality of self-propelled devices each of which picks up ore, washes and treats the ore and conveys the ore to a central relay unit designed to store ore and convey it with a mixture of sea water through a conduit to a surface ship. The present invention differs from the teachings of Moreau as contemplating a single self-propelled machine having buoyancy control and which may be coupled to a transport machine to be movable therewith.

U.S. Pat. No. 4,878,711 to Vinot et al. discloses a method and apparatus for mining of ocean floors which includes an elongated tube to mine and convey nodules.

The present invention differs from the teachings of Vinot et al. as contemplating a self-propelled machine which may be coupled to a transport machine with the self-propelled machine having buoyancy control and other sensors and controls.

As should be understood from discussion of the above-listed prior art, several problems exist with undersea mining devices as they are now known. The January, 1991 issue of "The Mining Engineering Journal" published an article by A. R. Bath which discussed many technical problems which exist in presently known undersea mining apparatuses as follows:

(1) Lifting of great amounts of sediment from the ocean floor to the surface wears out machine components, wastes energy and causes release of sediment at the ocean surface which may create environmental problems with sea life.

(2) Under most circumstances, the ocean floor where mineral nodules may be found is under at least 16,000 feet of water. Lifting materials through a vertical pipeline of this height presents many expensive and complicated technological problems.

(3) Most systems collect too much sediment with the nodules.

(4) It is difficult to convey a non-self-propelled mining machine from the surface of the ocean.

(5) Nodule mining systems operate under extremely harsh environments and complicated systems are disadvantageous.

(6) Self-propelled systems must be capable of negotiating obstacles which may not be detected by sonar forward scanning.

(7) Undersea mining systems must be capable of operating where the ocean floor includes very soft, deep sediments.

(8) Undersea mining systems must be able to traverse undersea hills and valleys.

It is with the problems and complications listed above in mind that the present invention was developed.

SUMMARY OF THE INVENTION

The present invention relates to a self-propelled undersea nodule mining system. The present invention includes the following interrelated objects, aspects and features:

(A) In a first aspect of the present invention, the present invention consists of two main components, a self-propelled mining machine, and a transport mechanism.

(B) The self-propelled mining machine may be propelled through the use of endless tracks, or, alternatively, may be propelled through the use of propellers, jets or any other suitable mechanism. In the preferred embodiment of the present invention, four such motive power mechanisms are provided, one at each corner of the self-propelled mining machine.

(C) The self-propelled mining machine has an internal chamber including a lower sub-chamber and an upper sub-chamber. The upper sub-chamber comprises a sealed chamber filled with air or other buoyant gas at extremely high pressure, for example, 20,000 psi. The upper sub-chamber is interconnected with the lower sub-chamber through a plurality of valved ports.

(D) The lower sub-chamber is exposed to ocean water at its normal sea bottom pressure through an opening through which protrudes a first conveyor as well as by virtue of an open bottom. The first conveyor interconnects with additional conveyors in an overlapping fashion with the first conveyor including an end distal from the self-propelled mining machine which may collect the surface of the ocean floor and convey it into the lower sub-chamber.

(E) As the surface of the sea bed is conveyed into the lower sub-chamber by the first conveyor, water is sprayed onto the collected sea bottom surface and the mesh-like surface of the conveyor allows small sediments and particles to be separated from the larger mineral nodules. As the nodules are conveyed from conveyor to conveyor, further water spray continues to clean the nodules until they are finally free of most, if not all, sediments. Thereafter, they are fed to a conveyor which conveys them to the associated transport machine which is detachably coupled to the self-propelled mining machine.

While sea bed surface collection is underway, depth finders, compass and a tilt gauge are employed to continuously feed information to a computer on-board the self-propelled mining machine so that the computer is always aware of the position, orientation and elevation of the machine. As nodules and sea bed surface materials are conveyed into the machine, naturally, the weight of the machine increases which would necessarily cause the machine to descend into the sea bed. The computer senses variations in buoyancy of the machine and controls the above-described valves to allow admission of air into the lower sub-chamber so that an air bubble is formed which may be increased in size as more and more sea bed surface materials are admitted.

(F) The computer is also used to control the motive power mechanisms to permit the machine to elevate and descend, turn, tilt and move forward and backward as may be the case. When the transport mechanism is filled with nodules, it may be decoupled from the mining machine and may be returned to the surface using a buoyancy system similar to the buoyancy system employed in the mining machine.

As such, it is a first object of the present invention to provide a self-propelled undersea nodule mining system.

It is a further object of the present invention to provide such a system including a mining machine with a transport mechanism which may be coupled thereto and decoupled therefrom.

It is a still further object of the present invention to provide such a system including a computer designed to sense depth, direction and attitude and to send control signals designed to control movements, orientation and operation of the inventive machine.

It is a yet further object of the present invention to provide such a system including internal conveyors combined with water spray mechanisms designed to spray and clean nodules which have been removed from the ocean bed.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
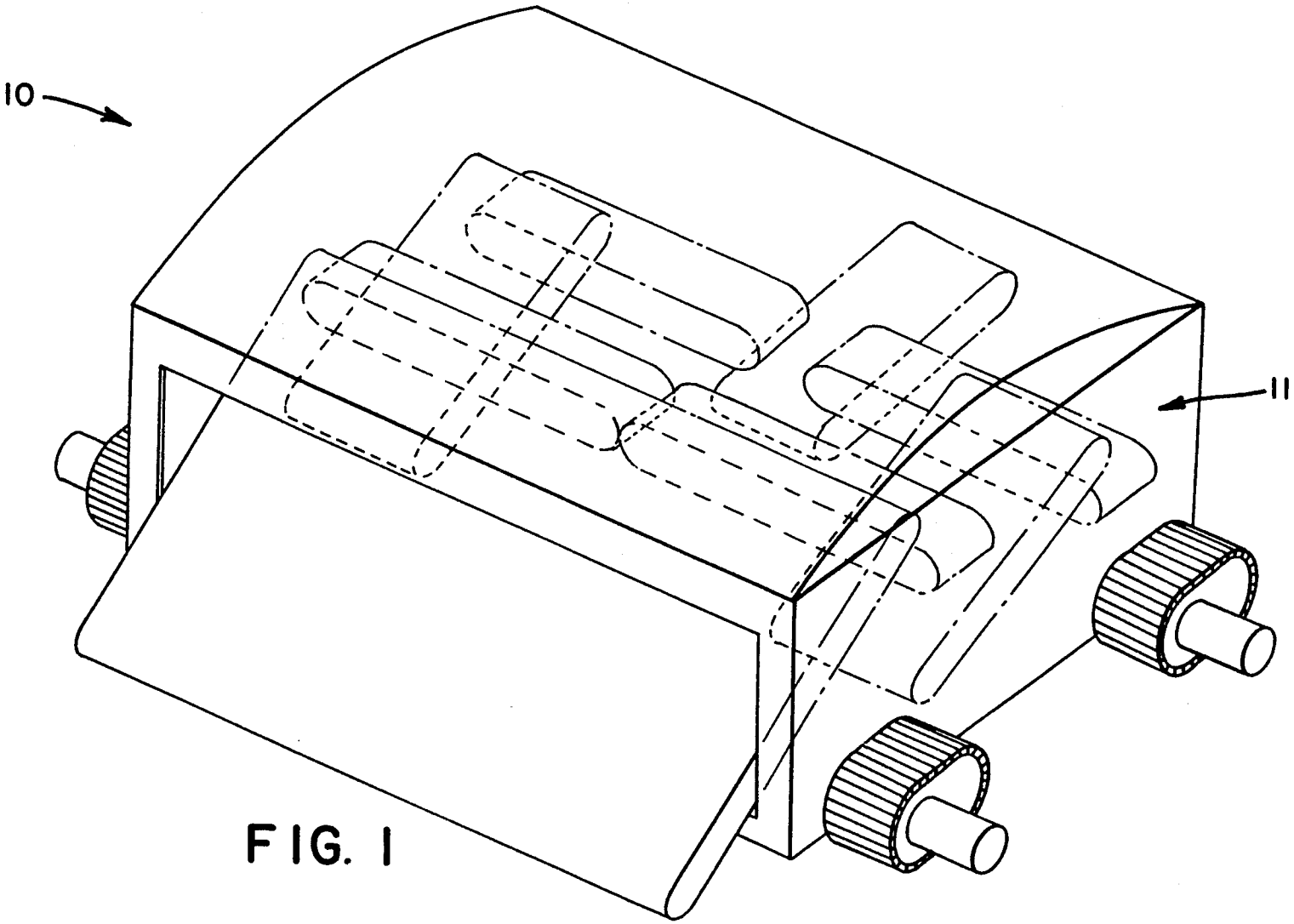
FIG. 1 shows a perspective view of the self-propelled mining machine aspect of the present invention, with certain portions thereof being shown in phantom.
Figure 2:
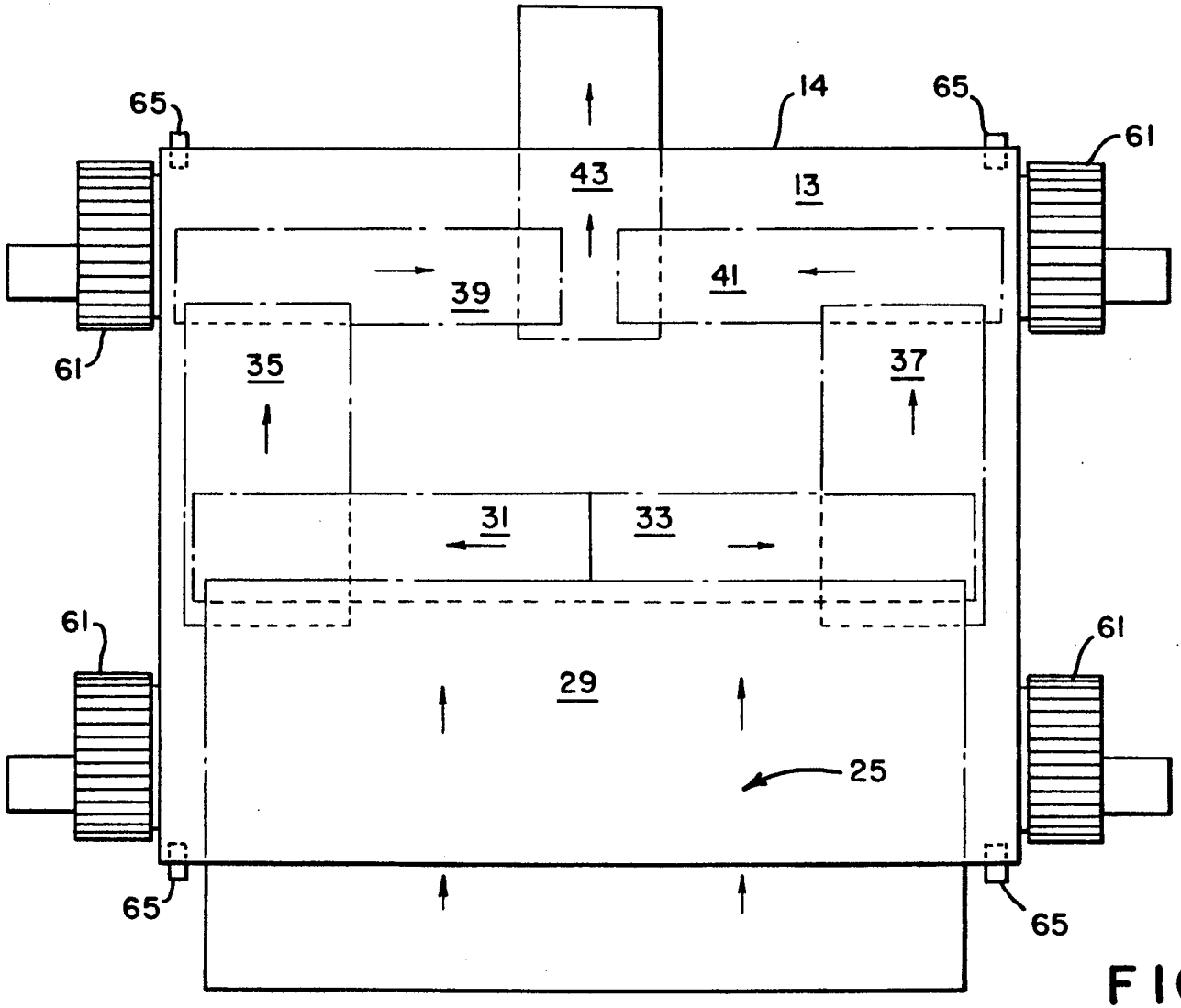
FIG. 2 shows a top view of the machine illustrated in FIG. 1, with certain portions thereof being shown in phantom.
Figure 3:
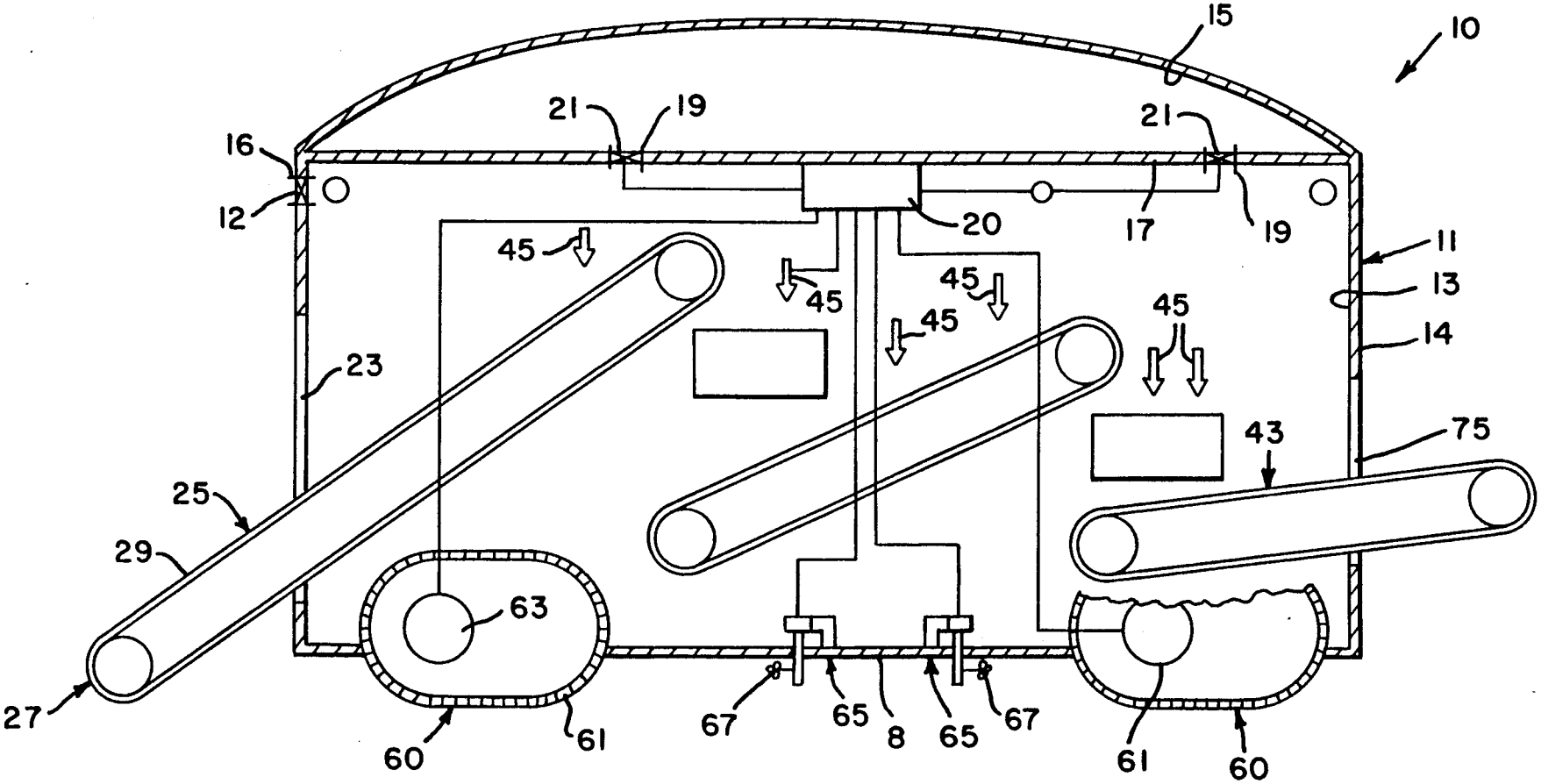
FIG. 3 shows a side view of the machine illustrated in FIGS. 1 and 2, with a side wall thereof being removed to show detail.

With reference, first, to FIGS. 1, 2 and 3, in particular, the present invention includes a self-propelled undersea mining machine generally designated by the reference numeral 10 and which is seen to include a housing 11 having an internal chamber divided into a lower sub-chamber 13 and an upper sub-chamber 15 by a sealed partition wall 17. As particularly shown in FIG. 3, the partition wall 17 has ports 19 extending therethrough which are controlled by valves 21. Within the upper sub-chamber 15, a high pressure atmosphere is maintained, for example, compressed air at a pressure of 10,000 to 20,000 psi. The valves 21 are controlled by a computer 20, as will be described in greater detail hereinafter. As should be understood, the buoyancy of the machine 10 is dependent upon the amount of water which is contained within the lower sub-chamber 13. Through control of the valves 21, the computer 20 may control the volume of air which is contained within the lower sub-chamber 13, and thereby may control the buoyancy of the machine 10. The provision of the location of the upper sub-chamber 15 provides a degree of buoyancy at that location to maintain the machine 10 in an upright configuration.

The lower sub-chamber 13 includes an opening 23 which provides access for a collecting conveyor 25 which extends from the housing 11 and out ahead of the machine 10. As the machine 10 is moved forward over the ocean floor, as will be described in greater detail hereinafter, the distal end 27 of the conveyor 25 will engage the ocean floor to allow collection of the surface thereof and conveyance of the surface on the belt 29 and into the lower sub-chamber 13. The opening 23 is located low enough to permit a large water-free working environment in the chamber 13.

With reference to FIGS. 1, 2 and 3, it is seen that the collecting conveyor 25 extends substantially the width of the lower sub-chamber 13 and supplies the surface of the ocean floor which has been collected to two laterally directed conveyors 31, 33 (FIG. 2, in particular) which direct the collected material in the direction of the arrows shown. These lateral conveyors 31, 33 direct the collected materials to two additional conveyors 35, 37 which convey the collected materials toward the rear wall 14 of the lower sub-chamber 13.

These conveyors 35, 37 supply the collected materials to two additional laterally directed conveyors 39 and 41 which convey the material, again, in the direction of the arrows shown toward the center of the lower sub-chamber 13, where the materials are deposited on a transfer conveyor 43 which conveys the materials through an opening in the wall 14 and to the transport device as will be described in greater detail hereinafter.

Figure 5:
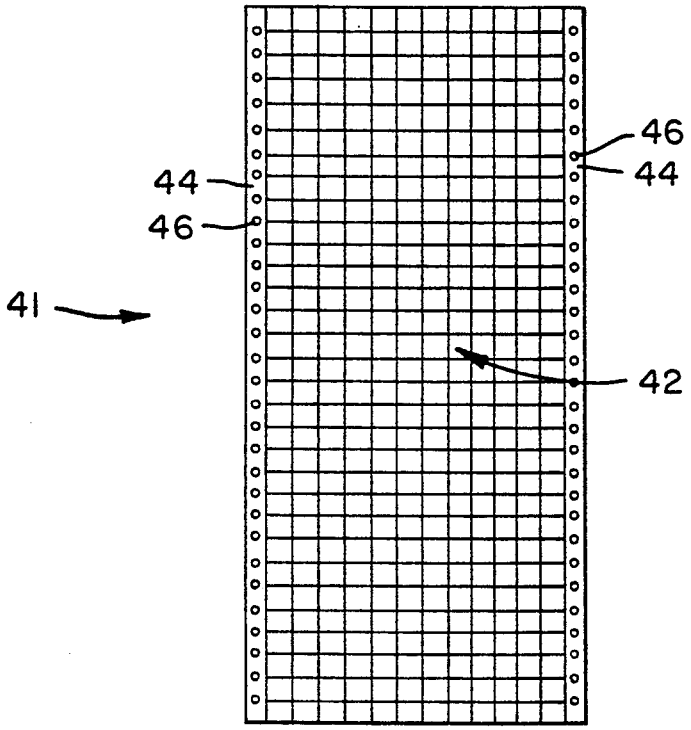
FIG. 5 shows a top view of a conveyor belt utilized in accordance with the teachings of the present invention.

With particular reference to FIG. 3, water spray devices 45 are schematically shown suspended above each conveyor. These water spray devices 45, under control of the computer 20, spray water at high pressure on the conveyors described above while materials from the ocean floor are being conveyed thereover. The spray devices 45 wash sediment and other materials from mineral nodules which may have been collected. In this regard, attention is now directed to FIGS. 5, 6 and 7 which describe in detail the conveyor 41 which is typical of conveyors made in accordance with the teachings of the present invention. As seen, with particular reference to FIGS. 5 and 6, the conveyor 41 includes a belt 42 which is made of a steel wire mesh material with the mesh material defining rectangular openings, as shown, which allow small sized sediments and other materials to pass therethrough while retaining nodules having dimensions larger than the dimensions of the openings in the steel wire mesh. Thus, each conveyor belt not only conveys materials from the ocean floor thereon but also acts as a separator separating small sized materials which are of little commercial value from the mineral nodules which are to be collected.

The belt 42 has edges 44 having holes 46 therethrough which are sized and spaced to enmesh with projections 48 (FIG. 7) on sprockets 38 mounted on axles 36 and which rotate under the control of the computer 20 by propulsion means such as hydraulic motors to control movements of the conveyor 41.

Figure 6:
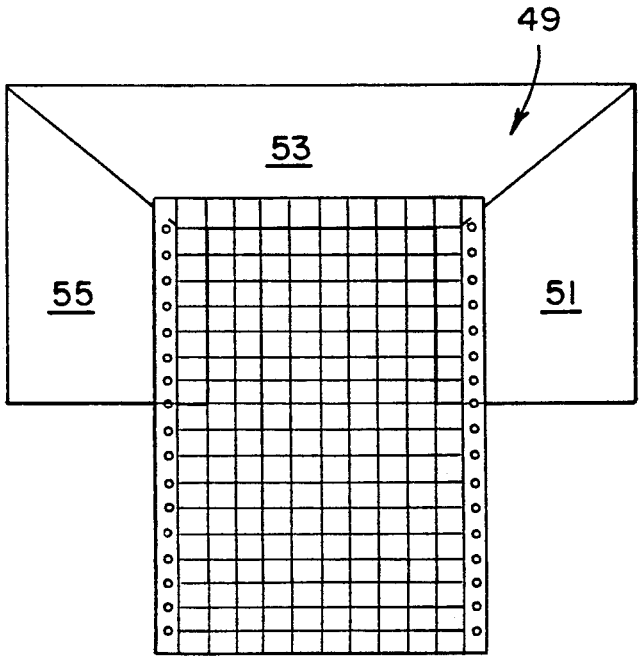
FIG. 6 shows a view similar to FIG. 5 but also showing a splash guard.
Figure 7:
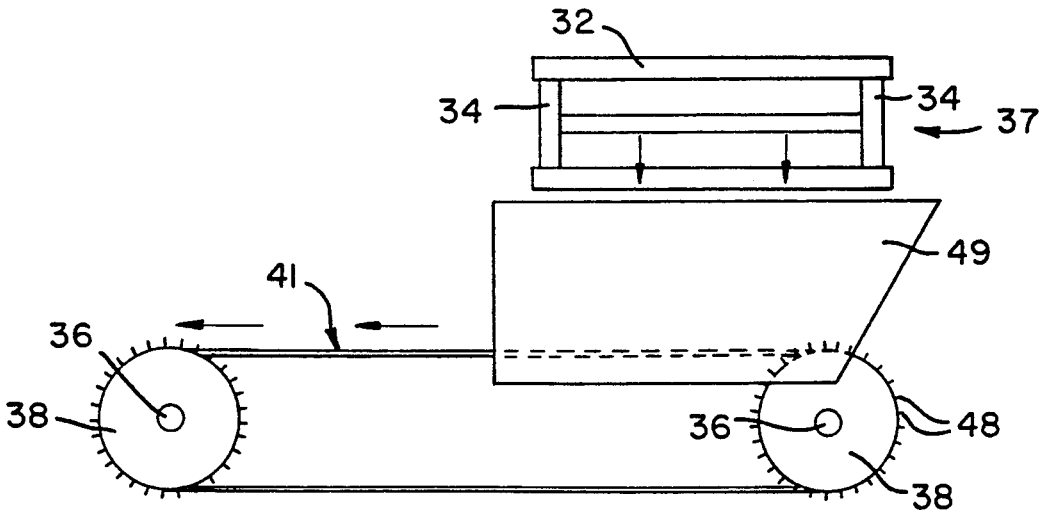
FIG. 7 shows a side view of a conveyor and splash guard.

With reference to FIGS. 6 and 7, it is seen that splash guards as the splash guard 49 are provided at the ends of the conveyor to guide materials from one conveyor to another. With reference to FIG. 6, the splash guard 49 is seen to include three walls 51, 53 and 55 which are angled as should be understood with reference to FIG. 7 to guide materials falling from the prior conveyor, in this example, the conveyor 37 onto the next conveyor 41. The splash guard 49 acts as a "funnel", funneling the materials from the conveyor 37, in this example, to the conveyor 41. Splash guards are provided at each interface between adjacent conveyors to prevent valuable mineral nodules from falling off the conveyor system and into the bottom of the lower sub-chamber 13. FIG. 7 shows the sprockets 34 which drive the belt 32 of the conveyor 37.

With reference to FIGS. 1-3, again, it is seen that the inventive machine 10 has propulsion means generally designated by the reference numeral 60. In the figures, two alternative means of propulsion are shown. With particular reference to FIG. 3, it is seen that the reference numerals 60 refer to track crawlers including endless tracks 61 rotated by schematically represented hydraulic motors 63. The operation of such systems is well known in the prior art per se. Additionally, the inventive device may be provided with propulsion systems 65 which comprise motor operated propellers 67. In this way, when the machine 10 is lifted off the ocean floor through increase in buoyancy through admission of air into the sub-chamber 13, the propellers 67 may be activated to allow adjustment of the orientation of the machine 10.

In this way, the track crawlers 60 with elongated teeth may be employed to move the inventive device as it lightly engages on the ocean floor while the propeller devices 65, 67 may be employed to rotate or otherwise move the device 10 when it is suspended above the ocean floor, such as, for example, when being moved laterally from an already harvested row of ocean floor to an adjacent row. FIG. 2 shows an alternative location for the propeller drive mechanisms 65. It is important to note that the lower tips of the propellers 67 must not extend below the lower portion of the tracks 61 so that they do not drag in the ocean floor when the tracks 61 are being employed.

Figure 4:
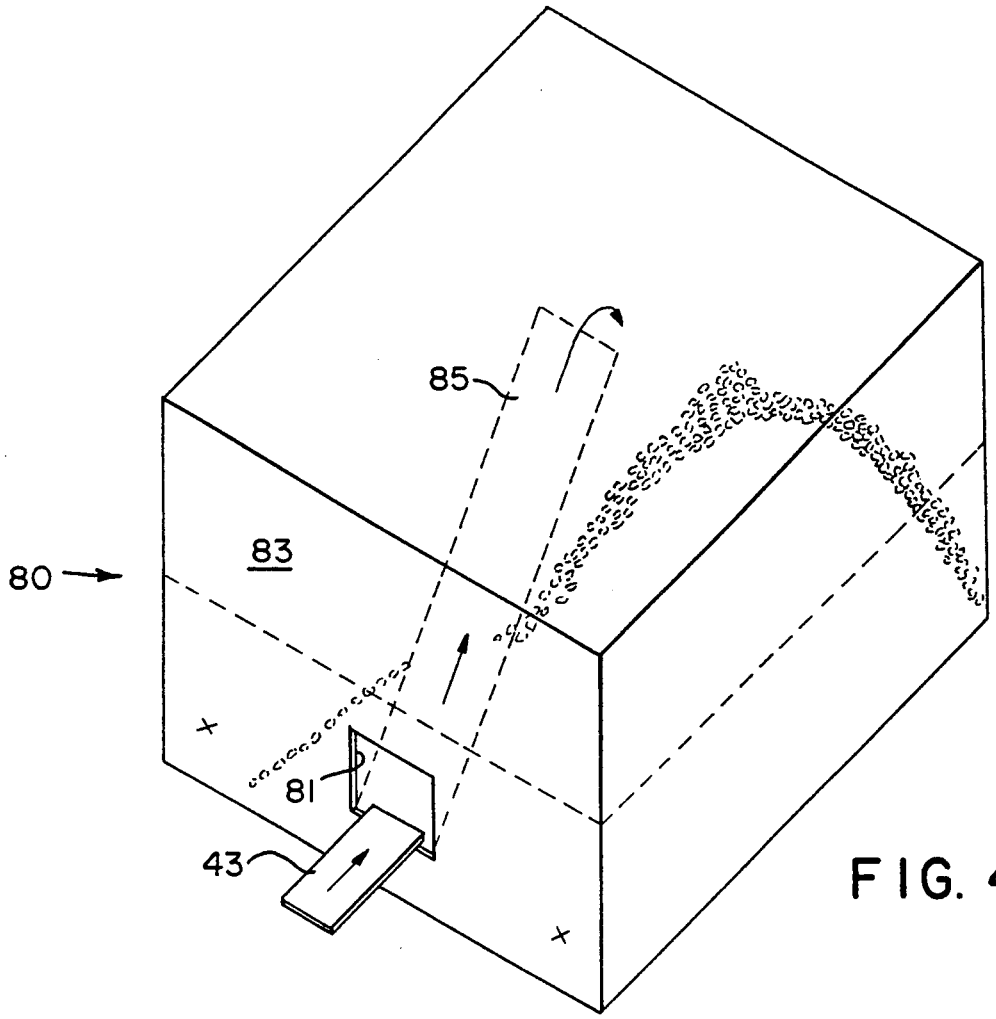
FIG. 4 shows a perspective view of the transport machine aspect of the present invention.

As shown in FIG. 3, the transfer conveyor 43 may be extended out through an opening 75 in the rear wall 14 so that mineral nodules which have been thoroughly cleaned may be transported to the transport machine 80 which is seen in FIG. 4. While not particularly shown in FIG. 4, the transport machine 80 has a similar configuration to that of the machine 10 in that an upper sub-chamber, which is not shown to allow detail to be revealed, is provided and contains a high pressure gas atmosphere such as, air, which may be selectively admitted into the lower portion thereof to adjust buoyancy as nodules are stacked in the lower sub-chamber thereof.

The transport 80 may be suitably coupled to the machine 10 so that the opening 81 in the transport 80 is aligned with the opening 75 in the machine 10. The transfer conveyor 43 is mounted within the lower sub-chamber 13 of the machine 10 on a mechanism operated under control of the computer 20 allowing it to be extended to the position shown, in particular, in FIG. 3, with the mechanism also permitting retraction of the transfer conveyor 43 so that it is wholly enclosed within the lower sub-chamber 13. The transport machine 80 has a wall 83 through which the opening 81 extends. When the transport machine 80 is coupled to the machine 10, the wall 83 of the transport machine 80 is flush against the wall 14 of the mining machine 10 with the openings 81 and 75 aligned. In that configuration, the transfer conveyor 43 may be extended to overlie the conveyor 85 contained within the lower sub-chamber of the transport machine 80. If desired, a splash guard such as the splash guard 49 may also be employed.

The coupling mechanism designed to couple the transport machine 80 to the mining machine 10 may be of any conventional type. Such devices are known in the prior art and only comprise an invention herein in combination with the other aspects described.

The conveyor 85 of the transport machine 80 may be operated by any suitable means such as, for example, a hydraulic motor system to transfer cleaned nodules from the machine 10 to the lower sub-chamber of the transport machine 80 where they are stacked in the lower sub-chamber thereof. As the transport machine 80 is filled with nodules, it necessarily becomes heavier. Thus, in a manner corresponding to the manner described above with regard to the machine 10, air is admitted from the upper sub-chamber of the transport into the lower sub-chamber thereof to increase buoyancy. At the same time, as nodules are transferred from the machine 10 to the transport machine 80, the buoyancy of the machine 10 is increased. In order to maintain its orientation and elevation, ports 16 are provided with valves 12 which may be selectively activated to allow bleeding of the air bubble from the lower sub-chamber 13 out into the surrounding ocean to decrease buoyancy to compensate for reduction in weight through removal of mineral nodules.

When the transport machine 80 has been filled with nodules to a level beyond which control of buoyancy will not be possible, the conveyor 43 is retracted into the machine 10, the opening 81 of the transport machine 80 is sealed through any suitable means, the transport machine 80 is uncoupled from the machine 10 and air is admitted into the lower sub-chamber of the transport machine 80 from the upper sub-chamber thereof (not shown) to increase buoyancy and cause the transport machine 80 to return to the surface of the ocean. A computer controlled valve (not shown) permits expulsion of sea water from the lower sub-chamber as air is admitted therein. If desired, an automatic check valve may be employed. In the preferred embodiment of the present invention, a separate computer such as the computer 20 employed in the mining machine 10 is also employed in the transport machine 80 to control buoyancy, operation of the conveyor 85, operation of the closure for the opening 81 and operation of coupling and uncoupling of the transport machine 80 to the mining machine 10. Alternatively, these functions may be controlled by the computer 20 through wireless communication with a receiver (not shown) mounted in the transport machine 80.

Figure 8:
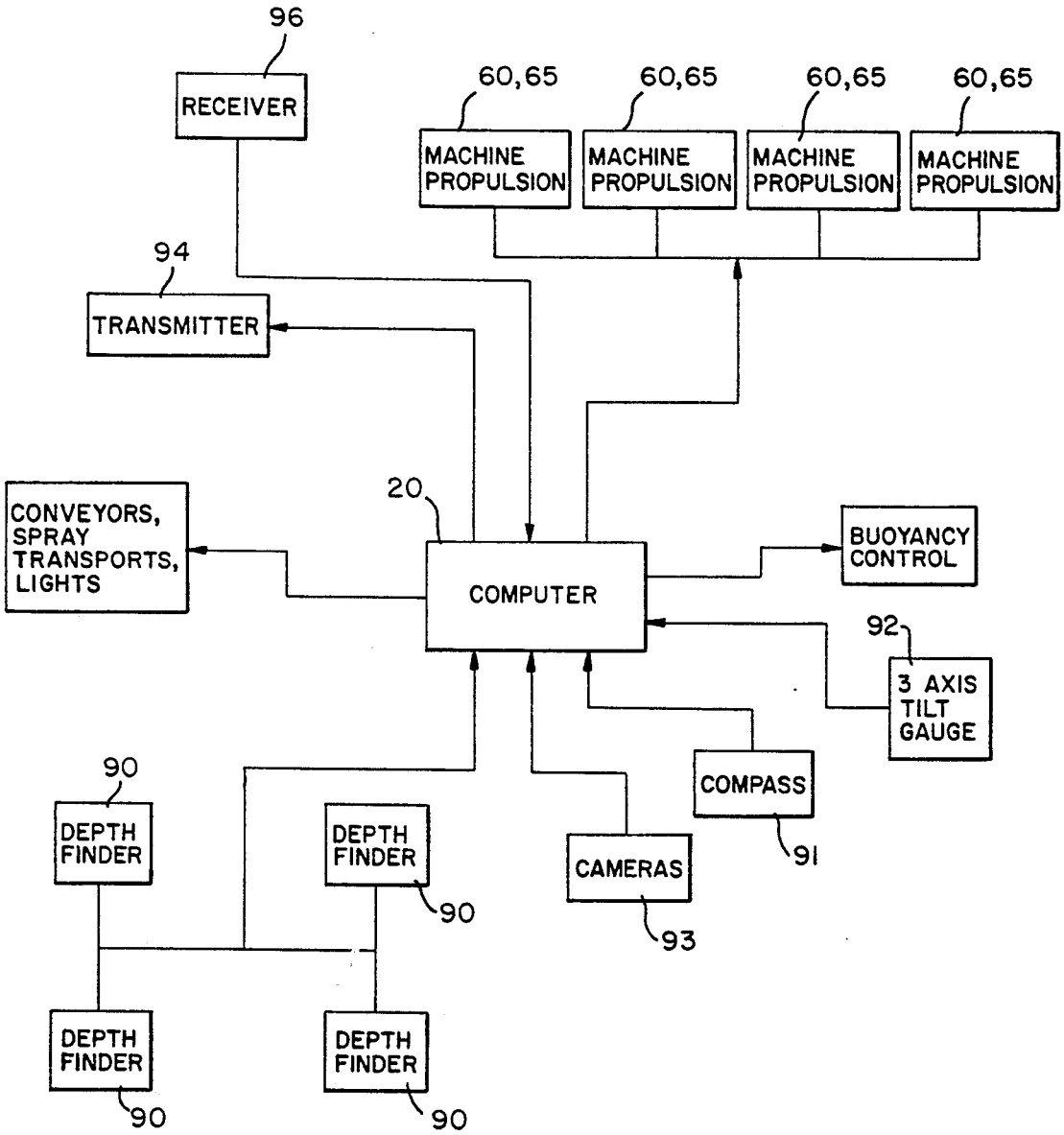
FIG. 8 shows a schematic representation of the electrical circuitry of the present invention.

With reference to FIG. 8, a schematic representation of the electrical circuitry related to the computer 20 is shown. With reference to FIG. 8, it is seen that the computer 20 receives signals from depth finders 90 mounted in each lower corner of the housing 11, from a compass 91 mounted in any suitable magnetically shielded location within the housing 11 and from a three axis tilt gauge 92 also suitably mounted within the housing 11. In this way, the computer is continuously fed information as to the elevation of the housing 11 over the sea bed, the orientation of the housing 11 with respect to the magnetic north pole or, alternatively, true north, and the specific orientation of the housing 11 in all three dimensions is determined and inputted. Additionally, cameras 93 located both exteriorly of the housing 11 and within the lower sub-chamber 13 thereof provide signals which are fed through the cameras and which may, via the transmitter 94, be transmitted to a vessel on the surface of the ocean along with other data from other sensors. A receiver 96 may receive control signals from a mother ship to facilitate control of the machines 10, 80.

Responsive to information received from the various sensors 90, 91, 92 and 93, the computer sends control signals to affect buoyancy control through operation of the valves 21, 12 and to move the machine 10 via the machine propulsion devices 60, 65. The computer 20 also sends signals to operate the conveyors, water spray, lights and those aspects of control of the transport machine 80 which are preprogrammed into the computer 20.

With the present invention having been described in great detail, a description of the intended operation thereof will now be made. The machine 10 with the transport machine 80 coupled thereto is lowered to the ocean floor either through the use of cables or through operation of the buoyancy controls thereof. Before such lowering takes place, the respective upper sub-chambers of the machine 10 and the transport machine 80 are charged with pressurized gas such as air at a high pressure such as, for example, 10,000 to 20,000 psi. Once the machines 10, 80 have reached the ocean floor, if cables were used in the lowering operation, they are uncoupled and retracted to the surface. Through the use of the buoyancy controls and the propulsion means 60, 65, the machines 10, 80 are moved to a position where the user has reason to believe that mineral nodules may be found. With the collecting conveyor 25 aligned in the direction of movement of the machine 10, the machine 10 with the machine 80 coupled thereto is moved in a forward direction through rotations of the endless tracks 61 which, as best seen in FIG. 3, have elongated claws allowing movement of the devices 10, 80 while the devices 60 are only lightly engaging the sea bed under buoyancy control of the computer 20. As the machines 10, 80 are moved in the forward direction, the surface of the sea bed is collected by the collecting conveyor 25 and is moved within the lower sub-chamber 13 whereupon this material is conveyed from the conveyor 25, to the conveyors 31, 33, to the conveyors 35, 37 and thence to the conveyors 39 and 41. While the material traverses these conveyors, water spray from the spray devices 45, under control of the computer 20, is sprayed on the materials to cause small sized sediments to pass through the openings in the wire mesh conveyor belts 42, leaving behind large sized mineral nodules. These mineral nodules are cleaned by the water sprays and are finally loaded onto the transfer conveyor 43, are conveyed through the opening 75 of the housing 11 and through the opening 81 in the transport machine 80 and are loaded onto the conveyor 85 which conveys the nodules and stacks them within the lower sub-chamber thereof. As these collection, conveying, cleaning, transfer and stacking operations take place, the buoyancy controls of the machines 10 and 80 are employed to maintain the position and orientation of the machines 10, 80 with respect to the ocean floor. The sensors 90, 91 and 92 are employed for this purpose.

Once the transport machine 80 has been filled with nodules to a weight capacity beyond which buoyancy control would be ineffective, this information is conveyed to the computer 20 which stops the operation of the conveyors, causes retraction of the transfer conveyor 43 and, through the on-board computer of the transport machine 80 (not shown), the opening 81 is sealed, the machine 80 is uncoupled from the machine 10 and the machine 80 is moved to the surface of the body of water through operation of the buoyancy controls thereof. The machine 80 is unloaded in any suitable manner and is then returned to the ocean floor.

In the preferred embodiment of the present invention, the bottom of the machine 10 is open so that sediments washed off the nodules as they move on the conveyors are immediately returned to the ocean floor.

As such, an invention has been disclosed in terms of a preferred embodiment thereof which fulfills each and every one of the objects of the present invention as set forth above and provides a new and useful self-propelled undersea nodule mining system of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A self-propelled undersea nodule mining system, comprising:

a) a mining machine including an upper sub-chamber containing pressurized gas and a lower sub-chamber separated from said upper sub-chamber by a partition;

b) said lower sub-chamber including conveyor means for conveying sea bed materials into said lower sub-chamber, said conveyor means including a first conveyor extending outside said machine through a wall opening thereof and at least one further conveyor within said lower sub-chamber and receiving said materials from said first conveyor;

c) valve means in said partition for controlling fluid connection between said upper sub-chamber and lower sub-chamber;

d) spraying means for spraying fluid on said materials as they are conveyed on said at least one further conveyor;

e) motive means for moving said machine within a sea; and f) computer means for controlling operation of said conveyor means, said valve means, said spraying means and said motive means;

g) whereby said computer means may control said valve means to control admission of gas to said lower sub-chamber to thereby adjust buoyancy of said machine, said admission of gas creating a gas bubble within said lower sub-chamber exposing at least a portion of said at least one further conveyor to said gas, said computer means controllably activating said spraying means so that sediment is cleaned from nodules, said buoyancy being adjusted to controllably suspend said machine slightly above a sea bed, said computer means controlling said conveyor means to cause said sea bed materials to be conveyed into said lower sub-chamber and to be sprayed therein, said computer means controlling said motive means to controllably adjust position and orientation of said machine with respect to said sea bed.

2. The invention of claim 1, wherein said at least one further conveyor comprises a plurality of further conveyors serially arranged within said lower sub-chamber.

3. The invention of claim 2, wherein said plurality of further conveyors comprises at least a first further conveyor terminating slightly above a starting location of a second further conveyor.

4. The invention of claim 3, wherein said starting location is surrounded by a splash guard.

5. The invention of claim 4, wherein each of said further conveyors includes a conveyor belt made of a mesh material.

6. The invention of claim 1, wherein said motive means comprises a plurality of track crawlers and at least one motor driven propeller.

7. The invention of claim 1, wherein said spraying means comprises a plurality of spray nozzles.

8. The invention of claim 1, wherein said gas comprises air.

9. The invention of claim 1, wherein said fluid comprises water.

10. The invention of claim 1, wherein said machine further includes at least one depth finder, at least one tilt gauge and at least one compass, all sending information signals to said computer means to facilitate control of said motive means.

11. The invention of claim 1, wherein said lower sub-chamber contains at least one camera connected to said computer means .

12. The invention of claim 1, further including a transport machine selectively coupled and uncoupled to said mining machine, said transport machine receiving mined materials from said conveyor means when coupled thereto, said transport machine having a storage chamber and buoyancy control means for controlling buoyancy thereof.

13. The invention of claim 12, wherein said conveyor means includes a movable conveyor extendable into said storage chamber and retractable therefrom.

14. The invention of claim 13, wherein said transport machine includes a side wall with a sealable access opening which, when unsealed, allows access of said movable conveyor.

* * * * *